US011240903B2

(12) United States Patent
Dekker et al.

(10) Patent No.: US 11,240,903 B2
(45) Date of Patent: Feb. 1, 2022

(54) CEILING PANEL SYSTEM WITH WIRELESS CONTROL OF CONNECTED LIGHTING MODULES

(71) Applicant: Light Corp Inc., Grand Haven, MI (US)

(72) Inventors: Ted Dekker, Norton Shores, MI (US); Cory Sackett, Grand Haven, MI (US); Peter Bombara, Holland, MI (US)

(73) Assignee: Light Corp Inc., Grand Haven, MI (US)

( * ) Notice: Subject to any disclaimer, the term of this patent is extended or adjusted under 35 U.S.C. 154(b) by 0 days.

(21) Appl. No.: 17/188,452

(22) Filed: Mar. 1, 2021

(65) Prior Publication Data

US 2021/0274624 A1 Sep. 2, 2021

Related U.S. Application Data

(60) Provisional application No. 62/982,554, filed on Feb. 27, 2020.

(51) Int. Cl.

| | |
|---|---|
| ***H05B 47/19*** | (2020.01) |
| ***E04B 9/04*** | (2006.01) |
| ***G08C 17/02*** | (2006.01) |

(52) U.S. Cl.

CPC ..... *H05B 47/19* (2020.01); *E04B 9/045* (2013.01); *G08C 17/02* (2013.01)

(58) Field of Classification Search

CPC .... B25J 9/1697; B25J 13/088; B25J 19/0029; B25J 19/02; B25J 5/007; B25J 9/0009;

(Continued)

(56) References Cited

U.S. PATENT DOCUMENTS 4,056,297 A 11/1977 Gartung
4,143,931 A 3/1979 Skare et al.

(Continued)

OTHER PUBLICATIONS

Singh et al., DC Power-Line Communication Reference Design, catalogue, Oct. 2013, pp. 1-47, TIDU160, Texas Instruments Incorporated, Dallas, TX. <http://www.ti.com/lit/ug/tidu160/tidu160.pdf>.

(Continued)

*Primary Examiner* — Monica C King

(74) *Attorney, Agent, or Firm* — Bodman PLC

(57) ABSTRACT

A ceiling panel system includes a panel assembly having a ceiling surface and first and second conductive structures spaced from each other and a first application module configured to engage one of a plurality of locations disposed over the ceiling surface. The first application module includes a wireless receiver, a first contact configured to engage the first conductive structure, and a second contact configured to engage the second conductive structure. The first conductive structure delivers power to the application module. The system also includes a second application module configured to engage a different one of the plurality of locations. The first application module is configured to receive at the wireless receiver wireless commands, and, responsive to receiving wireless commands at the wireless receiver, the first application module transmits the received commands over the first conductive structure to the second application module.

20 Claims, 12 Drawing Sheets

(58) Field of Classification Search

CPC ..... B25J 9/0015; B25J 9/102; B25J 9/1602; B25J 9/1617; B25J 9/162; B25J 9/1633; B25J 9/1664; B25J 9/1666; B25J 9/1669; B25J 9/1679; B25J 13/08; B25J 15/0683; B25J 19/023; B25J 9/026; H05B 47/19; H05B 45/20; H05B 47/175; H05B 45/10; H05B 47/105; H05B 45/31; H05B 47/10; H05B 47/11; H05B 47/115; H05B 47/165; H05B 47/195; H05B 45/24; H05B 47/185; H05B 2203/021; H05B 39/085; H05B 3/68; H05B 45/00; H05B 45/12; H05B 45/325; H05B 45/345; H05B 45/37; H05B 45/395; H05B 45/44; H05B 45/46; H05B 45/56; H05B 47/16; H05B 47/17; H05B 47/18; H05B 6/1209; H01H 19/14; H01H 2300/03; H01H 9/02; H01H 11/00; H01H 19/025; H01H 2223/034; H01H 2231/032; H01H 23/12; H01H 23/16; H01H 35/02; H01H 9/0207; H01H 9/0235; H01H 9/025; H01H 9/287; H01H 19/54; H01H 2219/062; H01H 23/14; H01H 19/115; H01H 19/585; H01H 2003/0293; H01H 2215/006; H01H 2219/056; H01H 2237/004; H01H 2237/008; H01H 2239/006; H01H 2239/048; H01H 23/025; H01H 23/145; H01H 7/08; H01H 9/0271

See application file for complete search history.

(56) References Cited

U.S. PATENT DOCUMENTS

| | | | |
|---|---|---|---|
| 4,278,834 | A | 7/1981 | Boundy |
| 4,451,113 | A | 5/1984 | Zuniga |
| 4,578,731 | A | 3/1986 | Andriessen et al. |
| 4,781,609 | A | 11/1988 | Wilson et al. |
| 4,920,467 | A | 4/1990 | Honsberger |
| 5,010,463 | A | 4/1991 | Ross |
| 5,013,252 | A | 5/1991 | Nienhuis et al. |
| 5,112,240 | A | 5/1992 | Nienhuis et al. |
| 5,131,860 | A | 7/1992 | Bogiel |
| 5,336,097 | A | 8/1994 | Williamson, Jr. et al. |
| 5,562,469 | A | 10/1996 | Nienhuis et al. |
| 5,606,919 | A | 3/1997 | Fox et al. |
| 5,695,261 | A | 12/1997 | Slesinger et al. |
| 5,768,840 | A | 6/1998 | Feldpausch et al. |
| 6,132,859 | A | 10/2000 | Jolly |
| 6,527,406 | B1 | 3/2003 | Slesinger et al. |
| 6,575,777 | B2 | 6/2003 | Henriott et al. |
| 6,688,901 | B2 | 2/2004 | Boyd et al. |
| 6,830,468 | B2 | 12/2004 | Schaerer et al. |
| 6,913,477 | B2 | 7/2005 | Dayan et al. |
| 7,465,178 | B2 | 12/2008 | Byrne |
| 7,665,883 | B2 | 2/2010 | Matheson |
| 7,726,973 | B1 | 6/2010 | Perry |
| 8,146,229 | B2 | 4/2012 | Henriott et al. |
| 8,235,826 | B2 | 8/2012 | Randall |
| 8,356,909 | B2 | 1/2013 | Verjans et al. |
| 8,390,184 | B2 | 3/2013 | Pet et al. |
| 8,444,425 | B2 | 5/2013 | Byrne |
| 8,496,492 | B2 | 7/2013 | Byrne |
| 8,525,402 | B2 | 9/2013 | Aeling et al. |
| 8,805,550 | B2 | 8/2014 | Chemel |
| 10,073,752 | B2 | 9/2018 | McWethy |
| 10,096,938 | B2 | 10/2018 | McClelland |
| 10,757,792 | B2 | 8/2020 | Dekker |
| 10,897,114 | B2 | 1/2021 | Bombara et al. |
| 10,959,314 | B2 | 3/2021 | Dekker |
| 2002/0005019 | A1 | 1/2002 | Trilli et al. |
| 2003/0015332 | A1 | 1/2003 | Hassam et al. |
| 2004/0026998 | A1 | 2/2004 | Henriott et al. |
| 2004/0095773 | A1 | 5/2004 | Gaskins et al. |
| 2004/0227472 | A1 | 11/2004 | Gaus, Jr. et al. |
| 2004/0228122 | A1 | 11/2004 | Slesinger et al. |
| 2009/0042428 | A1 | 2/2009 | Henriott et al. |
| 2009/0289578 | A1 | 11/2009 | Peng |
| 2010/0201202 | A1 | 8/2010 | Kirby et al. |
| 2010/0290215 | A1 | 11/2010 | Metcalf et al. |
| 2011/0084614 | A1 | 4/2011 | Eisele et al. |
| 2013/0207478 | A1 | 8/2013 | Metcalf et al. |
| 2014/0106610 | A1 | 4/2014 | Byrne et al. |
| 2014/0132171 | A1 | 5/2014 | Otake et al. |
| 2015/0115809 | A1 | 4/2015 | Siessegger |
| 2015/0115830 | A1 | 4/2015 | Siessegger |
| 2015/0351194 | A1 | 12/2015 | Sung |
| 2016/0081160 | A1 | 3/2016 | Vangeel et al. |
| 2016/0174333 | A1 | 6/2016 | Kim et al. |
| 2016/0286627 | A1 | 9/2016 | Chen et al. |
| 2017/0175987 | A1 | 6/2017 | Newton et al. |
| 2017/0278383 | A1* | 9/2017 | Dimberg ..... G01D 5/02 |
| 2018/0219582 | A1 | 8/2018 | Scott et al. |
| 2019/0158265 | A1 | 5/2019 | Hwang et al. |
| 2019/0260829 | A1 | 8/2019 | Cencini et al. |
| 2021/0126413 | A1 | 4/2021 | Bombara et al. |
| 2021/0168921 | A1 | 6/2021 | Bombara et al. |
| 2021/0211319 | A1* | 7/2021 | See ..... H05B 47/19 |
| 2021/0217566 | A1* | 7/2021 | Shi ..... H01H 19/585 |
| 2021/0266701 | A1* | 8/2021 | Kuber ..... H04L 67/10 |

OTHER PUBLICATIONS

Singh et al.. Power line communication implementation for DC applications, article, Feb. 2014, EDN Network, https://www.edn.com/design/power-management/4427860/1/Power-line-communication-implementation-for-DC-applications.

* cited by examiner

CEILING PANEL SYSTEM WITH WIRELESS CONTROL OF CONNECTED LIGHTING MODULES

CROSS-REFERENCE TO RELATED APPLICATION

The present application claims benefit and priority under 35 U.S.C. § 119(e) of U.S. provisional application Ser. No. 62/982,554, filed Feb. 27, 2020, which is hereby incorporated herein by reference in its entirety.

TECHNICAL FIELD

This disclosure generally relates to power distribution systems and, more particularly, to power sources that are configurable to deliver power to one or more accessories in a ceiling.

BACKGROUND

Suspended ceiling systems and structural supports are widely used in building constructions to provide a simple ceiling system that can easily be installed in place. Typically, suspended ceilings provide permanently wired-in accessories such as lights and speakers. For example, electrical wires carrying electricity are run specifically to a particular desired panel where a transformer will convert the electricity into a form usable by the accessory. These wires must be run to each panel that is to include a light or other accessory. Thus, suspended ceiling systems are generally difficult to change or reconfigure and require a large amount of wiring.

SUMMARY

One aspect of the disclosure provides a ceiling panel system that includes a panel assembly having a ceiling surface and first and second conductive structures spaced from each other and spanning beneath the ceiling surface. A first application module is configured to engage one of a plurality of locations disposed over the ceiling surface of the panel assembly. The first application module includes a wireless receiver, a first contact configured to engage the first conductive structure, and a second contact configured to engage the second conductive structure. The second contact is electrically insulated from the first contact and the first conductive structure for the panel assembly to deliver power to the first application module. A second application module is configured to engage a different one of the plurality of locations disposed over the ceiling surface of the panel assembly and receive power from the first conductive structure. The first application module is configured to receive wireless commands at the wireless receiver. Responsive to receiving wireless commands at the wireless receiver, the first application module transmits the received commands over the first conductive structure to the second application module.

Implementations of the disclosure may include one or more of the following optional features. In some implementations, the first and second application modules each include an attachment feature that is configured to attach and support the respective application module at the ceiling surface of the panel assembly. In some examples, the attachment feature includes a magnet arranged to bias the respective application module against the ceiling surface of the panel assembly. Optionally, the first conductive structure includes a metal panel having a plurality of openings that define the plurality of locations for engaging an application module. The ceiling surface of the panel assembly is defined by the metal panel.

In some examples, the second conductive structure includes a metal panel disposed in generally parallel planar alignment with the first conductive structure, and the second contact is configured to extend through the first conductive structure to engage and form an electrical connection at the metal panel. The panel assembly may include an insulating spacer disposed between the first and second conductive structures to maintain spacing away from each other. The second application module may include an output device, such as a light source or speaker.

In some implementations, the system further includes a plurality of panel assemblies. The wireless receiver may include one of a Wi-Fi receiver or a Bluetooth receiver. Optionally, the system further includes a third application module configured to engage a different one of the plurality of locations disposed over the ceiling surface of the panel assembly than the first application module and the second application module, and responsive to receiving wireless commands at the wireless receiver, the first application module transmits the received commands over the first conductive structure to each other application module. The first conductive structure may provide DC power to each application module. In some examples, the received commands are transmitted over the first conductive structure using a serial protocol.

Another aspect of the disclosure provides a ceiling panel system that has a panel assembly with first and second conductive structures spaced from each other in planar parallel alignment and spanning horizontally to define a downward-facing ceiling surface. The panel assembly is configured to electrically connect to a power source for delivering power from the power source. A first application module is configured to engage one of a plurality of locations disposed at the ceiling surface of the panel assembly and receive power from the power source. The first application module includes a wireless receiver configured to receive a wireless command. The first application module also includes a first contact configured to engage the first conductive structure and a second contact configured to engage the second conductive structure, where the first and second contacts are configured to electrically connect to the panel assembly to deliver power from the power source to the first application module. A second application module includes an output device and is configured to engage a different one of the plurality of locations and deliver power from the power source to the output device. In responsive to receiving a wireless command at the wireless receiver, the first application module transmits the received commands over the panel assembly to the second application module. The commands received from the first application module operate to control functionality of the output device.

In some implementations, the output device of the second application module includes a light source. In some examples, the first application module includes a lighting device, where in responsive to receiving the wireless command at the wireless receiver and transmitting the received commands, the first application module operates to control functionality of the lighting device in substantially same manner as the light source of the second application module.

In yet another aspect of the disclosure, a ceiling panel system includes a panel assembly that has first and second conductive structures spaced from each other in planar parallel alignment and spanning horizontally to define a ceiling surface. The panel assembly is configured to electrically connect to a power source for delivering power from the power source. A first application module is configured to engage a first one of a plurality of locations disposed at the ceiling surface of the panel assembly and receive power from the power source. The first application module includes a wireless receiver that is configured to receive a wireless command. The first application module also includes a first contact configured to engage the first conductive structure and a second contact configured to engage the second conductive structure. The first and second contacts are configured to electrically connect to the panel assembly to deliver power from the power source to the first application module. A second application module includes an output device. The second application module is configured to engage a second one of the plurality of locations and deliver power from the power source to the output device of the second application module. A third application module also includes an output device. The third application module is configured to engage a third one of the plurality of locations and deliver power from the power source to the output device of the third application module. In response to receiving a wireless command at the wireless receiver, the first application module transmits the received commands over the panel assembly to the second and third application modules. The commands received from the first application module operate to control functionality of the output devices of the second and third application modules.

These and other objects, advantages, purposes, and features of the present disclosure will become apparent upon review of the following specification in conjunction with the drawings.

Each of the above independent aspects of the present disclosure, and those aspects described in the detailed description below, may include any of the features, options, and possibilities set out in the present disclosure and figures, including those under the other independent aspects, and may also include any combination of any of the features, options, and possibilities set out in the present disclosure and figures.

BRIEF DESCRIPTION OF THE DRAWINGS

Corresponding reference numerals indicate corresponding parts throughout the drawings.

DETAILED DESCRIPTION

Figure 1A:
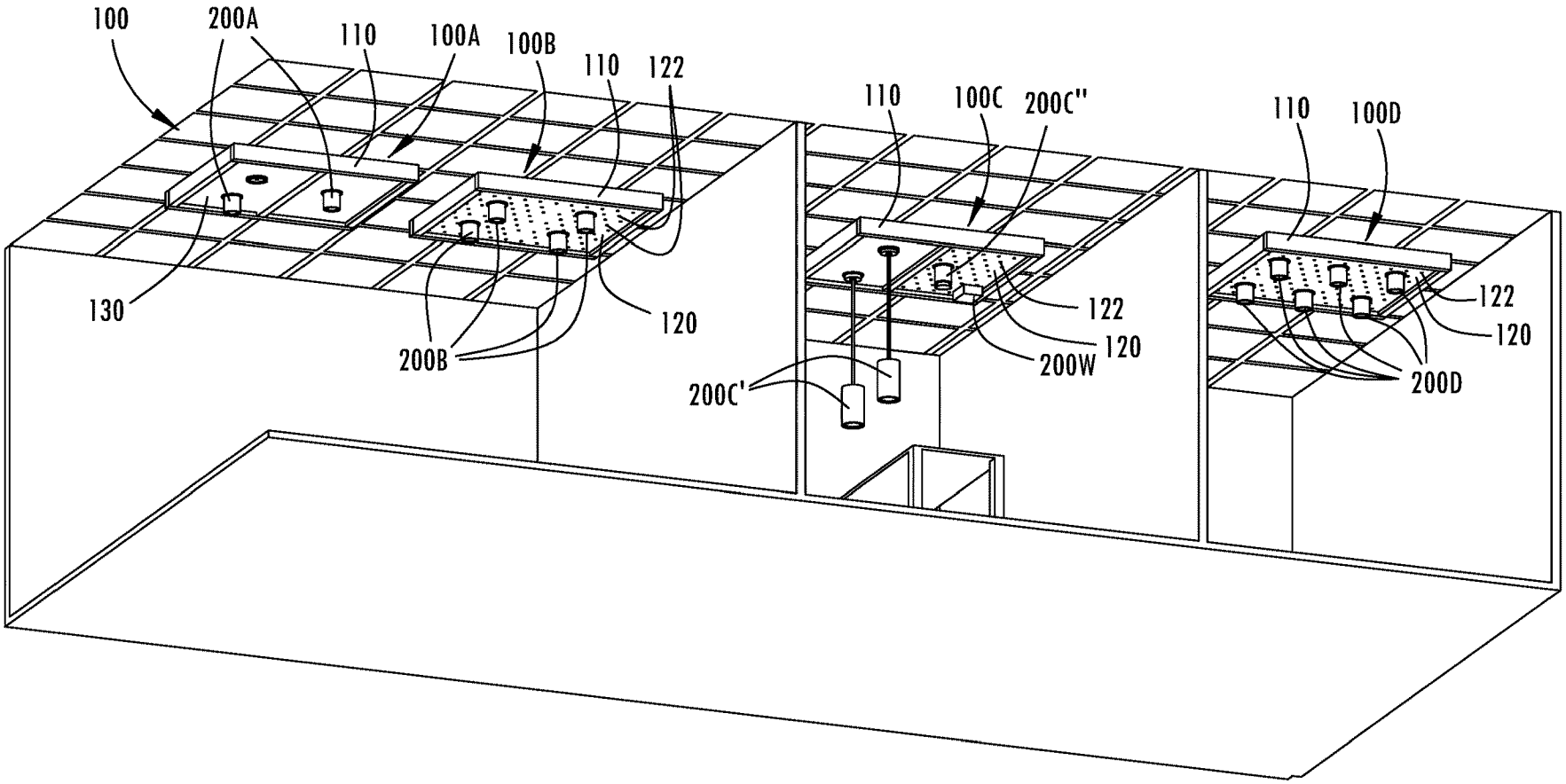
FIG. 1A is an environmental perspective view of multiple exemplary ceiling panel systems with different panel assemblies and different engaged application modules.

Referring now to the drawings and the illustrative embodiments depicted therein, a ceiling panel system is provided that includes a panel assembly that is capable of receiving and supporting one or more application modules (e.g., lighting modules) at multiple different engaged locations on the panel assembly, so as to position the modules at desirable locations. The panel assembly may be connected to an auxiliary power source, such as a power supply that is connected to a standard electrical outlet (e.g., a 110V or a 220V power source). The application modules electrically connect at the engaged locations of the panel assembly so as to power or deliver electricity to the integrated component or components of the application modules, such as a light, a speaker, or the like. One or more of the application modules (e.g., a wireless application module) may receive wireless control signals from a control module (e.g., via Wi-Fi). The one or more application modules may transmit or forward the received control signals over a power conductor of the panel assembly that each application module (e.g., data over power application modules) is in electrical contact with. In this way, a single wireless control module may control each connected application module without each application module requiring the expense and logistics required to have an independent wireless connection.

To form the electrical connection between the panel assembly and an engaged application module, the application module may include a first contact that engages a first conductive structure of the panel assembly and a second contact that engages a second conductive structure of the panel assembly. The second contact is electrically insulated from the first contact and the first conductive structure for the panel assembly to deliver power to the application module. The application modules may also be easily disengaged and relocated and engaged to other desired locations on the panel assembly or otherwise substituted with other types of application modules, so as to allow for simplistic interchangeability and customization of the ceiling panel system. Control signals for a portion of the application modules is transmitted from a select application module (e.g., the module having wireless communication capability) over the first conductive structure (e.g., a power plane) to each other application module connected to the first conductive structure. In this way, a user is provided with the ability to control other engaged application modules through, for example, a single wireless connection, while also providing simplistic interchangeability and customization of the system.

Referring now to the drawings and the illustrative examples depicted therein, a ceiling panel system includes one or more panel assemblies. As shown for example in FIGS. 1A and 1B, the panel assemblies 110 of the ceiling panel systems 100 may be suspended from or otherwise disposed at discrete locations of a ceiling structure, such as a frame of a suspended ceiling, a structure above a suspending ceiling, or other structural member capable of supporting the panel assembly or assemblies and the various engaged application modules. As shown in FIG. 1A, four exemplary ceiling panel systems 100A, 100B, 100C, 100D are provided in separate areas of a building, shown in separate divided spaces or separate rooms. Each of these ceiling panel systems have a single panel assembly 110 that is configured to engage multiple application modules. Some or all of the four ceiling panel systems 100A, 100B, 100C, 100D and other ceiling panel systems may be connected together as a single system 100. In such a single system, the individual ceiling panel systems may be subdivided into groups or zones for operation, such as for operating two or more ceiling panel systems 100A and 100B in a single room together. Moreover, the panel assembly or assemblies in a panel system may have various shapes and configurations adapted for the size, design, and layout of the applicable location, such as larger or smaller panel assemblies and more or few engagement locations. For example, as shown in FIG. 1A, the panel assembly 110 of the ceiling panel system 100A has predefined engagement locations defined by trim components provided in holes of the insulating cover disposed over the panel assembly, and the panel assembly 110 of the ceiling panel system 100B has a plurality predefined holes 122 in a first conductive structure 120 exposed and accessible for application modules to engage.

With further reference to FIG. 1A, the first and second ceiling panel systems 100A, 100B are disposed together in a single area or room, where each panel assembly 110 has a set of application modules 200A, 200B attached to and electrically engaged at desired locations of the plurality of locations 122 of the panel assembly 110. Each of the application modules 200A, 200B include a lighting device or light source to illuminate the corresponding area or room in which it is located, such application modules may be referred to as can-light assemblies. As shown, for example, in FIG. 1A, a third ceiling panel system 100C is installed in a room divided by walls from adjacent areas and rooms. The third ceiling panel system 100C has two different examples of application modules 200C' and 200C" attached to and electrically engaged at desired locations of the plurality of locations 122 on the panel assembly 110. On the third ceiling panel system 100C, the application modules 200C' each have a lighting device or light source that is suspended from an engagement element, such as by a rod, cord, or chain or the like. Such application modules 200C' may be referred to as pendant light assemblies.

As also shown in FIG. 1A, the room with the third ceiling panel system 100C has a table provided below the panel assembly, where the pendant light assemblies are installed over the table for a desired illumination effect of the table surface. With the flexibility and customizability of the ceiling panel systems, it is possible for the lighting in the room to be easily modified, such as if the table was removed, the application modules 200C' may be easily detached and replaced with desired application modules, such as can-light assemblies or the like. Thus, as rooms are reconfigured to different uses, such as tables or desks being relocated in a restaurant or office building, application modules may be easily reconfigured and replaced to adapt the lighting to correspond with the function of the room layout.

Moreover, the third ceiling panel system 100C shown in FIG. 1A includes a second type of application module 200C" attached to and electrically engaged at a desired location. The second type of application module 200C" includes a speaker device, which may include one or more types of speakers configured to output high quality audio. Further, a wireless application module 200W is attached at the third ceiling panel system 100C that is configured to receive wireless control signals from a control module (e.g., via Wi-Fi) and transmit or forward the received control signals over the panel assembly to each connected application module 200C' and 200C". While an application module may be dedicated to perform such wireless transmission, such as the wireless application module 200W of the third ceiling panel system 100C, it is also contemplated that a wireless transceiver may be incorporated in an application module that has an output device, such as a lighting device or speaker or the like. For example, the fourth ceiling panel system 100D includes a further example of a ceiling panel assembly 110 with six connected and electrically engaged application modules 200D, at least one of which includes such wireless communication capabilities.

Figure 1B:
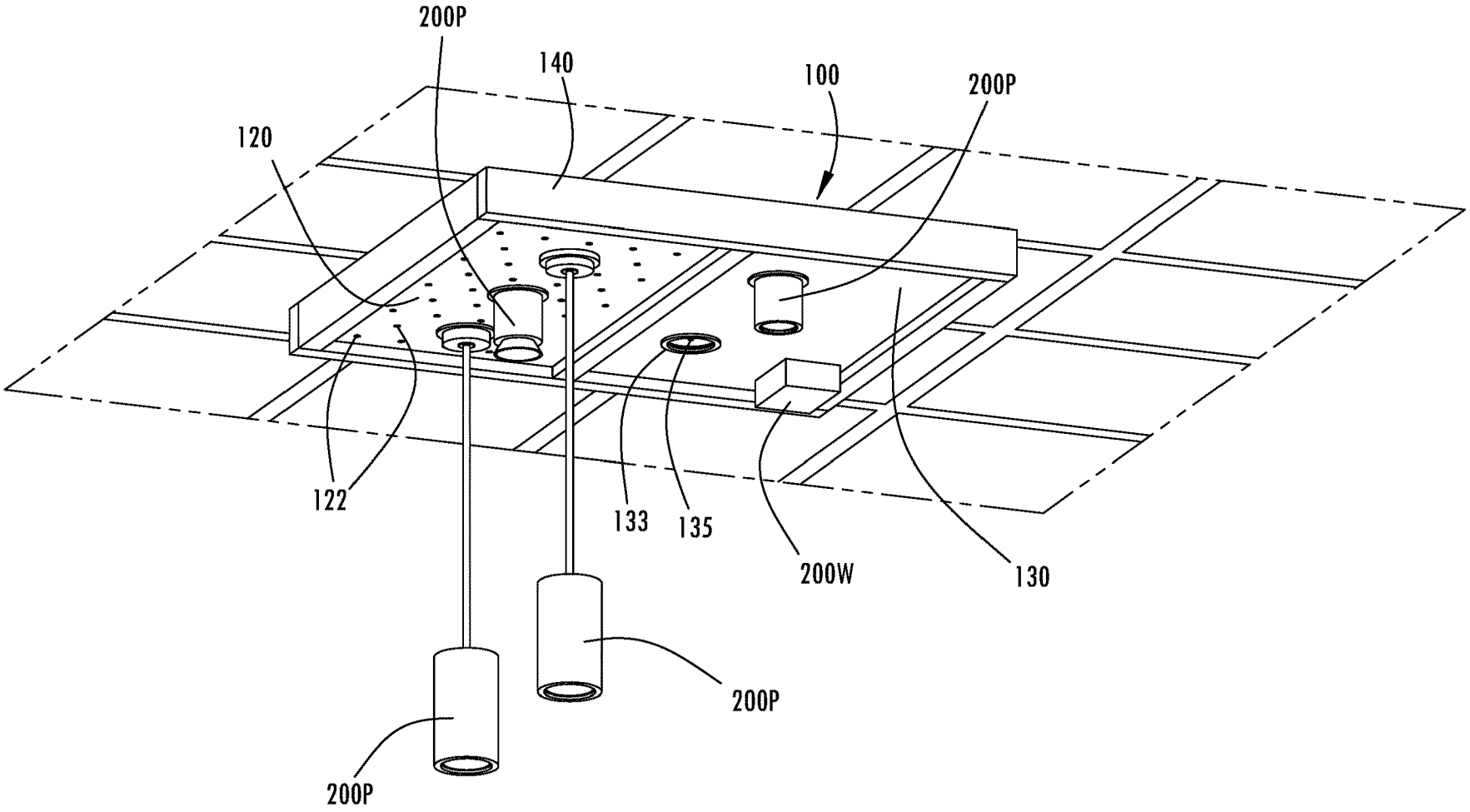
FIG. 1B is an environmental perspective view of an additional ceiling panel system with a panel assembly having various engaged application modules.
Figure 4A:
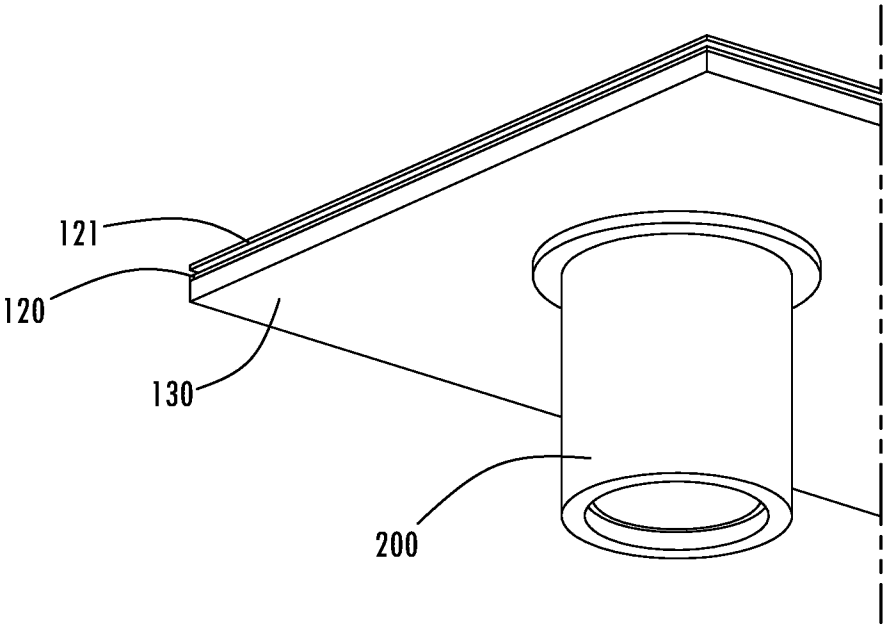
FIG. 4A is a perspective view of a section of a ceiling panel system, showing an application module engaged at the panel assembly.

With reference to FIG. 1B, each panel assembly 110 includes a first conductive structure 120 and a second conductive structure 121 (FIG. 4A). The first conductive structure 120 (e.g., a metal panel) includes a plurality of locations 122 for engaging one or more application modules 200. The conductive structures or panels may be substantially planar and oriented in planar parallel alignment with each other in the panel assembly 110. In additional implementations, one or both of the conductive structures may be an arrangement of metal strips or wires. The panels may be disposed beneath an insulating cover 130. An outer frame 140 may attach around the peripheral edge of the conductive structures to support the structures and insulating cover. The separation between the conductive structures allows them to have opposing electrical polarity, so as to be capable of powering an accessory module 200. An insulating spacer may be disposed between the conducting structures such as an electrically insulating stand-off piece or substrate layer. For example, insulating washers may be disposed at fasteners that hold the conductive structures at a backing structure or frame. Alternatively, the conductive structures may be insulated from each other by an air gap, which may be maintained by the rigidity of the structures and the structure of the outer frame 140.

Figure 4B:
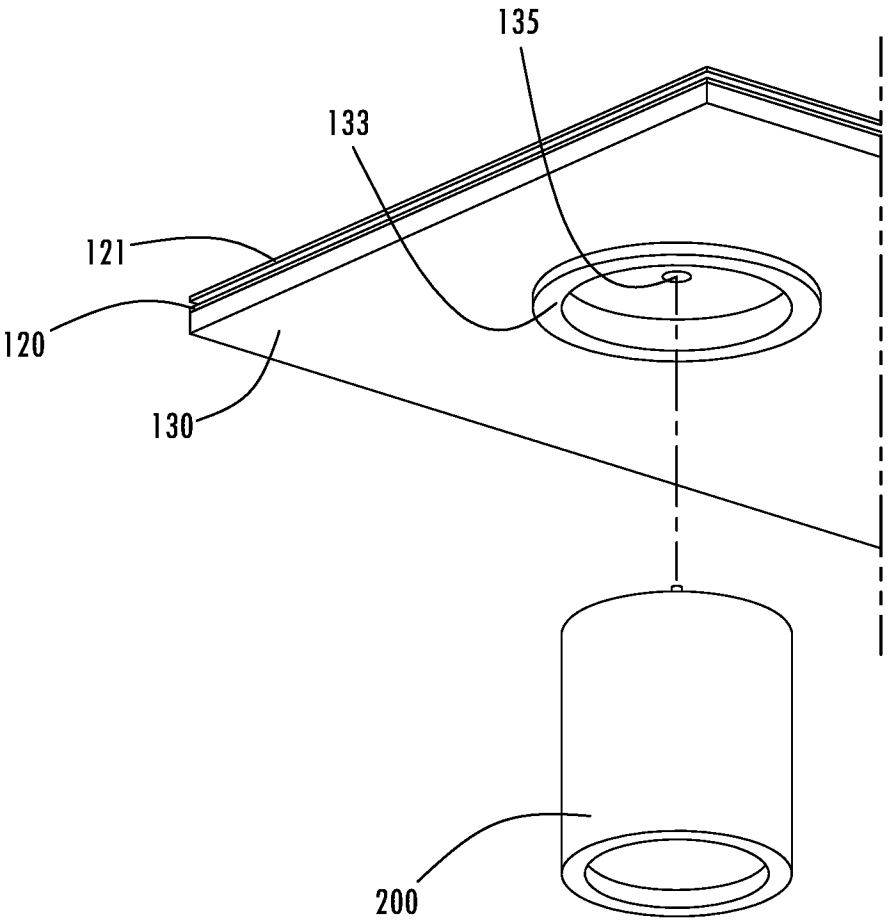
FIG. 4B is a perspective view of the section of the ceiling panel system of FIG. 4A, showing the application module disengaged from the panel assembly.
Figure 4C:
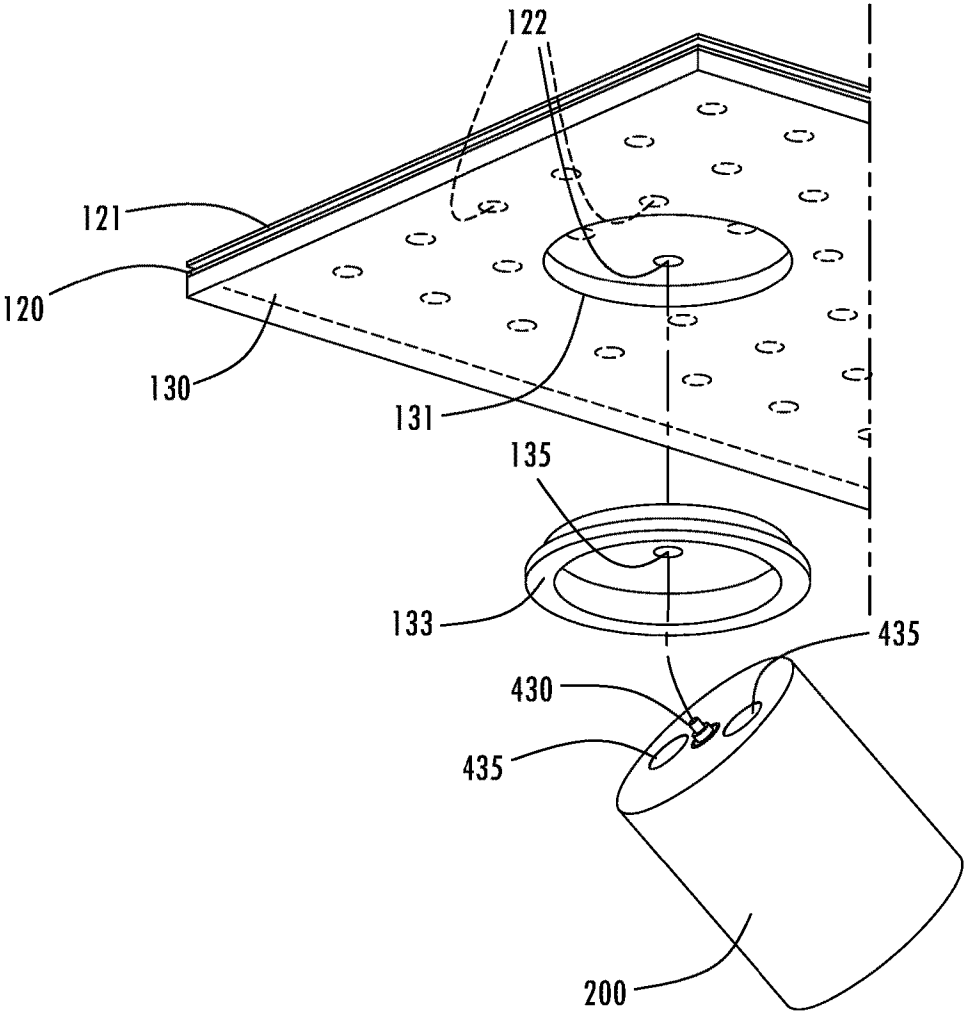
FIG. 4C is a perspective view of the section of the ceiling panel system of FIG. 4A, showing the application module disengaged and a trim component removed from the panel assembly.
Figure 4D:
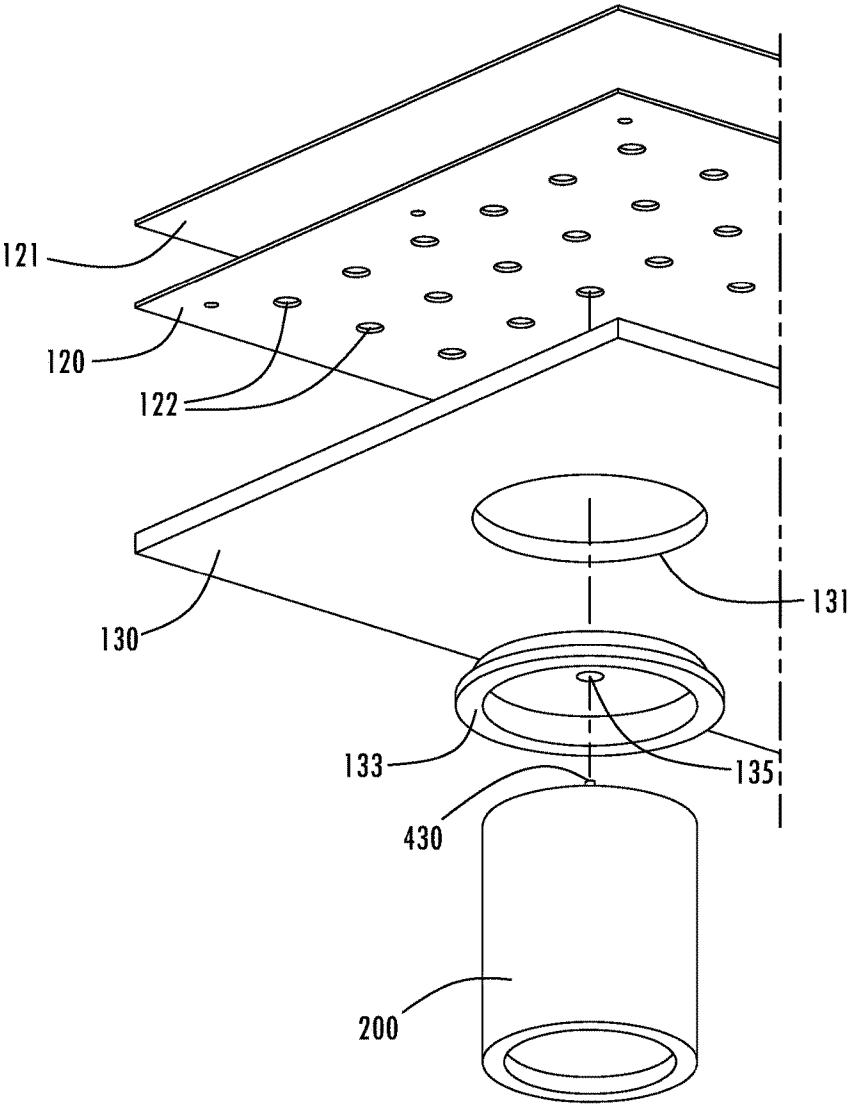
FIG. 4D is an exploded perspective view of the section of the ceiling panel system of FIG. 4A.

As shown in FIGS. 4A-4C, the cover 130 may include openings 131 to receive an application module 200. Optionally, as further shown in FIG. 4C, a trim component 133 may be installed in the opening 131 of the cover 130 with a peripheral rim of the trim component 133 circumscribing the opening 131 and an opening 135 in the trim component 131 aligning with an engagement location 122 (e.g., hole 122) in the panel assembly 110. Each application module 200 may attach to the panel assembly 110 at a desired location of a plurality of predefined locations 122 where contacts 430, 431 on the application module 200 engage the conductive structures 120, 121.

Figure 2:
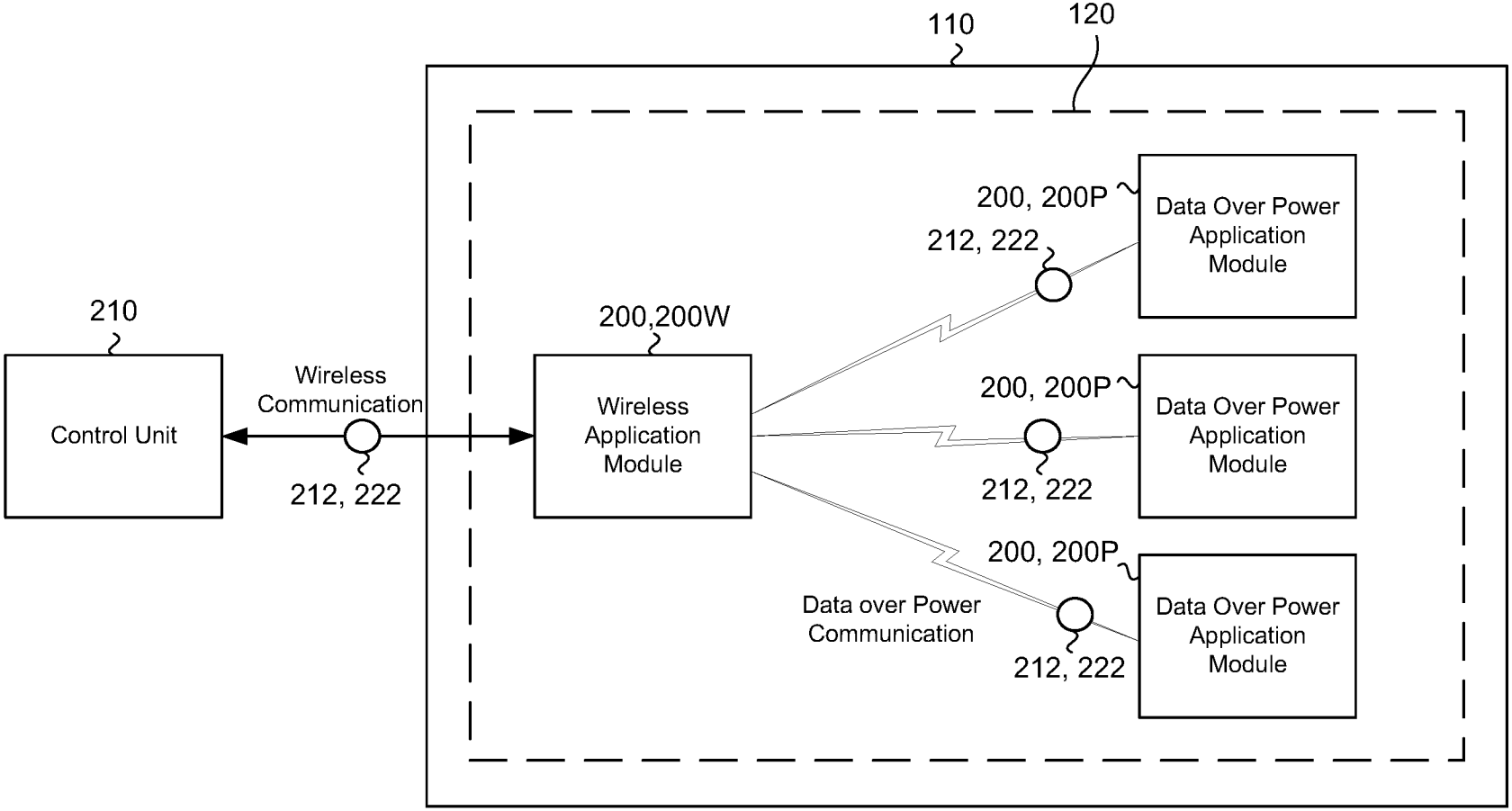
FIG. 2 is block diagram of a panel assembly of a ceiling panel system.

Referring now to FIG. 2, each application module 200 is in electrical contact with the first conductive structure 120 and the second conductive structure 121 (FIG. 4A) in order for the first conductive structure to deliver power to the respective application module 200. In some implementations, one or more of the application modules 200 is a wireless application module 200, 200W or hub module. The wireless application module 200W receives wireless commands 212 from a control unit 210. The wireless application module 200W, in some implementations, forwards or otherwise transmits the received wireless commands 212 to each other engaged application module 200. The wireless application module 200W may transmit received commands 212 to one or more data over power application modules 200P. For example, the wireless application module 200W may couple communications (e.g., the received commands 212) over the first conductive structure 120. Because each application module 200 is in electrical contact with the first conductive structure 120 in order to receive electrical power, each application module 200P receives the coupled communications 212 simultaneously with the received electrical power.

The wireless commands 212 includes data to command or control (i.e., change the behavior of) one or more of the engaged application modules 200. The commands 212 may be configured to control the wireless application module 200W, a data over power application module 200P, or some combination thereof. For example, one or more of the data over power application modules 200P may be a light source. The control unit 210 may send commands to the wireless application module 200W to actuate or control the operation, intensity, and/or color of the light source. The application modules 200 may include a variety of other functions (e.g., a speaker, a display, etc.) that each may be controlled accordingly via the commands 212. For example, the wireless application module 200W may receive audio signals from the control unit 210 and forward the audio signals to a speaker (i.e., a data over power application module 200P). In another example, the received wireless commands 212 may request information to be returned by the wireless application module 200W. For example, the control unit 210 may query the wireless application module for status information 222 regarding the wireless application module 200W or one or more of the data over power application modules 200P. The wireless application module 200W may directly return the appropriate status information 222 or alternatively query the engaged data over power application modules 200P to retrieve the appropriate status information 222.

Each module 200 may include a unique identifier that the control unit 210 may use to specifically address a specific application module 200. For example, each module may have a unique serial number and each wireless command 212 may be associated with one or more serial numbers of the application modules 200. Each module 200 may receive each received command 212 from the control unit and subsequently determine if the command 212 is addressed to the respective module 200. When the command 212 is addressed to the respective module 200, the corresponding module 200 performs an appropriate action to fulfill the command 212. When the command 212 is not addressed to the respective module 200, the corresponding module may discard the command 212. Similarly, a select set of modules may be grouped together with a grouping serial number to respond together with a common command.

Figure 3:
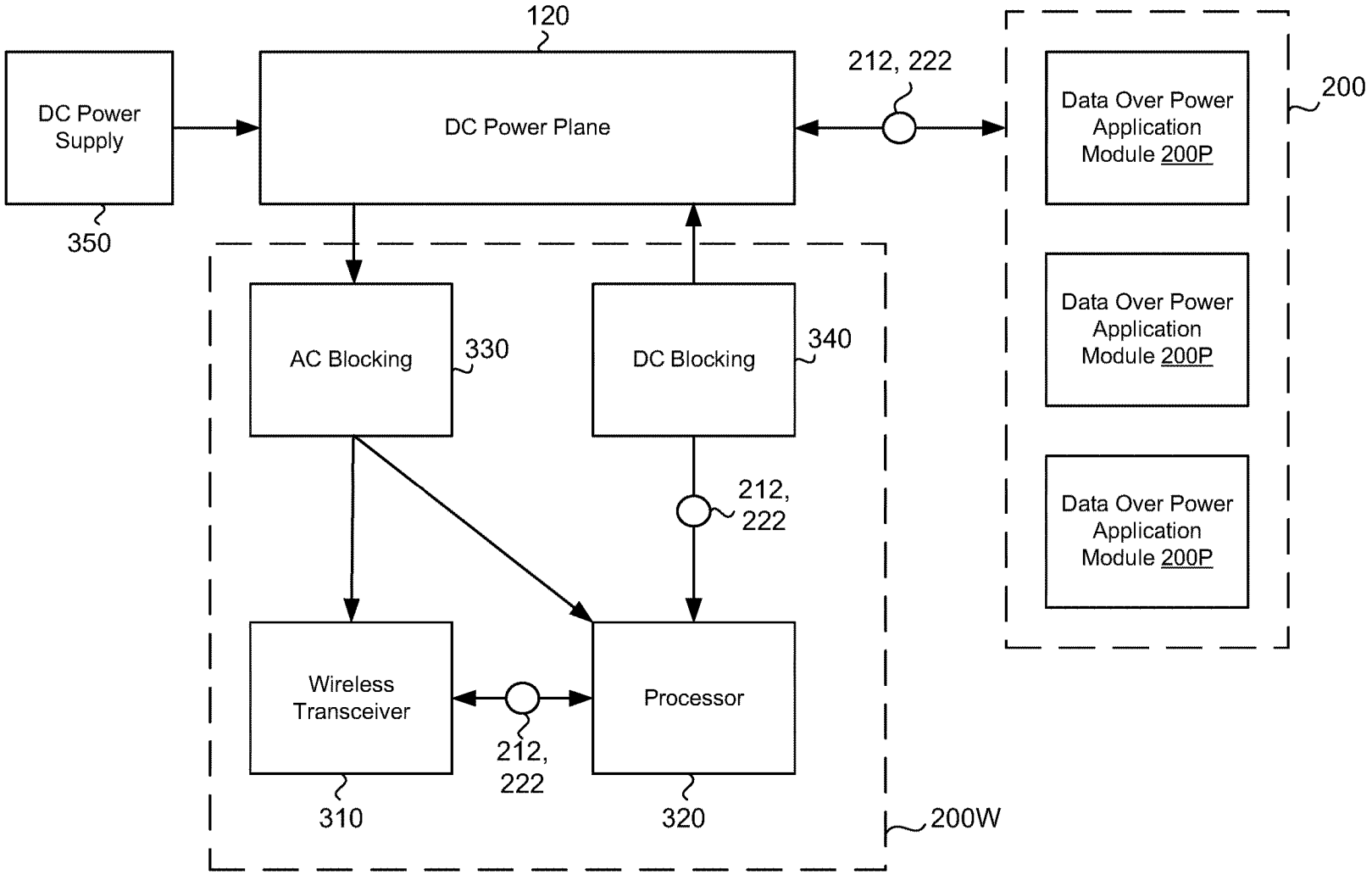
FIG. 3 is a block diagram of a wireless application module of the ceiling panel system of FIG. 2.

Referring now to FIG. 3, in some examples, the wireless application module 200W includes a wireless transceiver 310. The wireless transceiver 310 is configured to wirelessly communicate with a wireless transceiver of the control module 210. In some implementations, the wireless transceiver may include a separate wireless receiver and wireless transmitter. The wireless transceiver may communicate via any appropriate wireless technology (e.g., Wi-Fi, ZigBee, or Bluetooth). The wireless application module 200W also includes a processor 320. The processor 320 receives and processes the commands 212 received from the control unit 210 via the wireless transceiver 310. The wireless application module 200W is electrically powered via the first conductive structure 120 (i.e., a power plane). In some examples, the wireless application module 200W is provided with DC power (e.g., from a DC power supply 350). The power supply 350 may be a class 2 power supply that reduces the connected voltage to, for example, 24 volts, where the connected voltage may be 120 volts supplied by a standard electrical outlet. It is understood that the other examples of the power supply may deliver different voltage level and may be direct current (DC) or alternating current (AC) to similarly supply power to the panel assembly. The wireless application module 200W may include AC blocking 330 on the power to remove, for example, any AC components (e.g., communications) prior to powering the processor 320 and transceiver 310.

The processor 320, after performing any required processing of the commands 212, transmits the processed commands 212 to the DC power plane 120. DC blocking 340 may remove the DC power offset from any communications received back from other modules 200 (e.g., status information). The commands pass, via the DC power plane, to each other module 200 (e.g., data over power application modules 200P or other wireless application modules 200W). Returned communications may again travel to the wireless application module 200W via the DC power plane 120. In some examples, the data over power application modules may also communicate with each other via the DC power plane.

Each data over power application module 200P may include similar components as the wireless application module. For example, each data over application module 200P may include a processor 320, AC blocking 330, and DC blocking 340. However, because the modules receive commands 212 via the power plane 120, the data over application modules 200P do not require a wireless transceiver, thus reducing cost and wireless spectrum congestion.

In some implementations, the modules 200 communicate via a serial protocol. For example, the modules 200 may use any half or full-duplex asynchronous serial protocol, which generally does not require an accompanying timing signal on another conductor, such as a USB protocol, RS-422 protocol, RS-485 protocol, or the like. Synchronous interfaces (e.g., SPI protocol, I2C protocol, etc.) may also be used to transmit communications between the modules 200, such as by multiplexing the signals onto the power panel 120. Each module 200 may include termination (e.g., terminations resistors) to reduce or prevent reflections. In some examples, the termination may be variable to adjust to a number, a type, or a location of modules.

Figure 5:
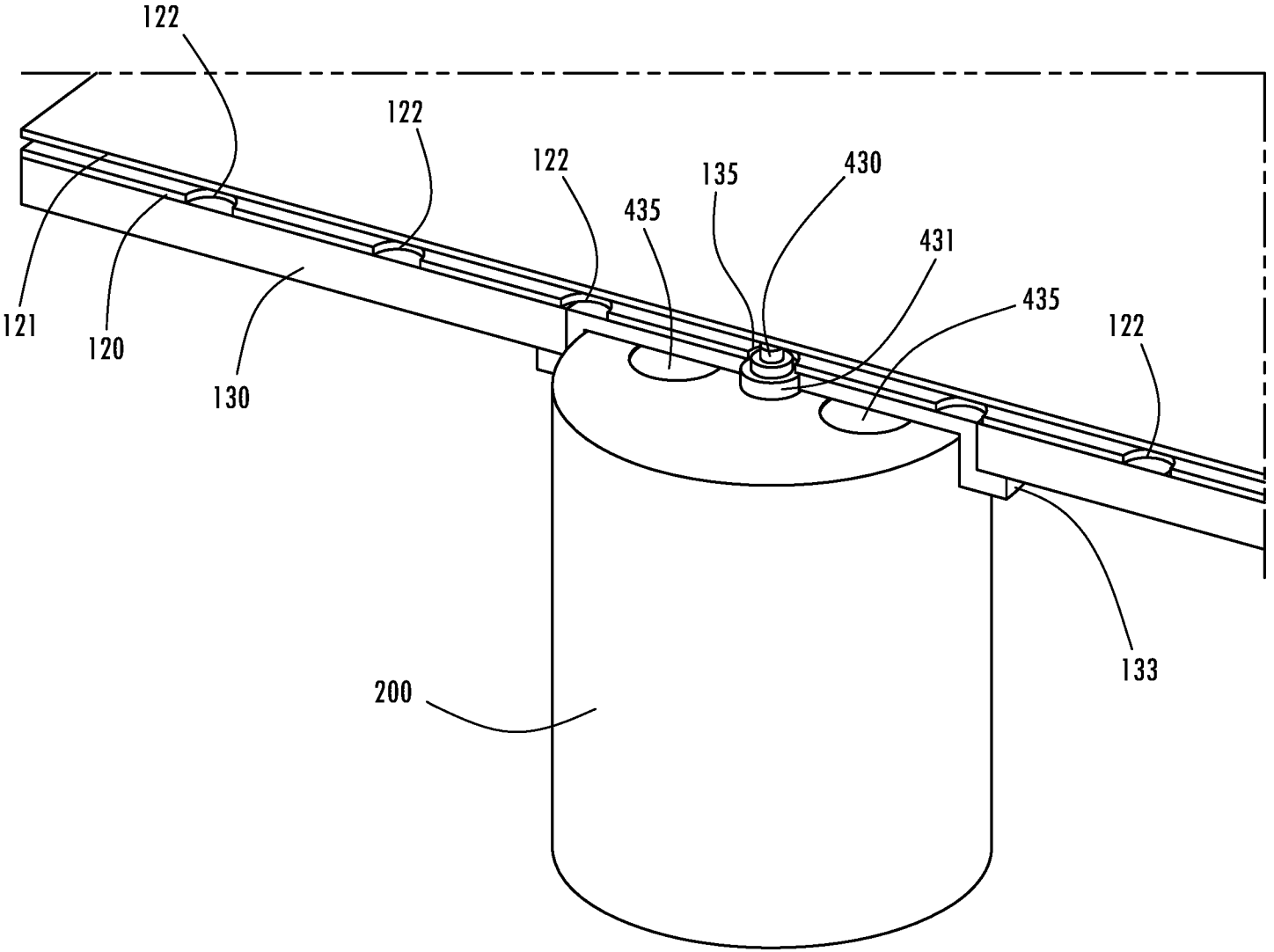
FIG. 5 is a cross-sectional perspective view of the ceiling panel system of FIG. 4A, showing the application module engaged at the panel assembly with an electrical connector.
Figure 6:
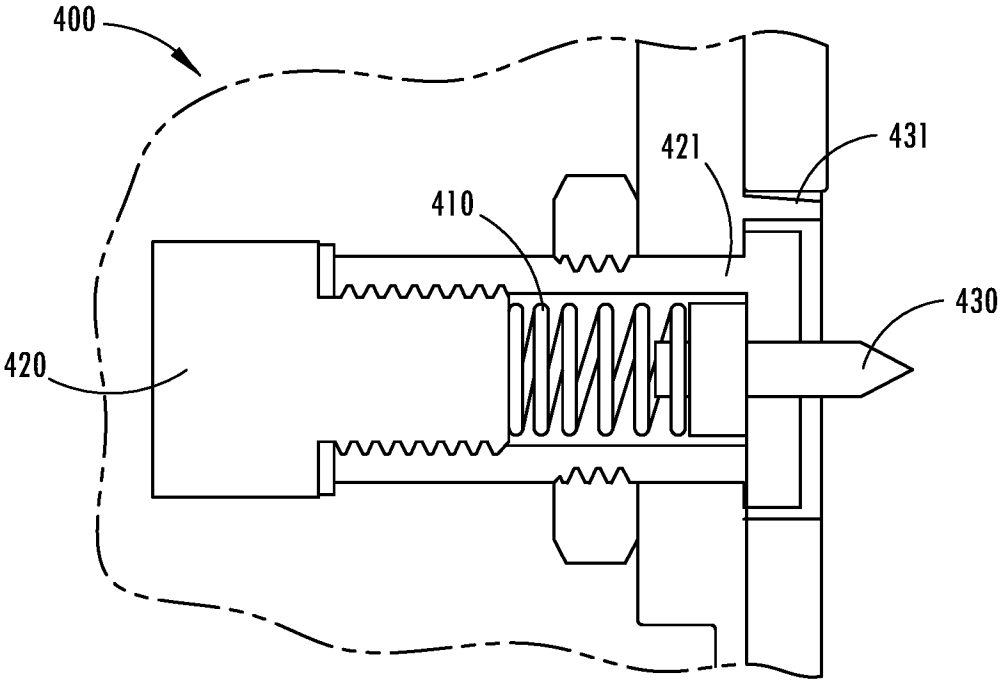
FIG. 6 is a cross-sectional view of electrical connector of the application module shown in FIG. 5, showing a spring-loaded contact stud configured to engage the panel.

Referring now to FIG. 6, to facilitate a stable and consistent electrical connection with the device or module, a connector, such as a spring pin assembly, may be provided on or within the module. As shown in FIG. 6, a spring pin assembly 400 includes a first contact 431 configured to engage the lower conductive structure 120 and a second contact 430 that is configured to contact the upper conductive structure 121. The first contact 431 of the spring pin assembly 400 is fixed relative to the application module housing and is configured to engage the periphery of the hole in the lower conductive structure 120 (FIG. 5). The second contact 430 of the spring pin assembly is provided as a stud that is movable and spring biased relative to the application module housing, such that the second contact 430 provides a biased force and contact against the upper conductive structure 121. The first and second contacts 430, 431 are electrically insulated from each other, such as by a tubular housing 421 made of an insulating material (e.g., a polymer or the like) that physically separates the contacts. As shown in FIG. 6, the spring pin assembly 400 includes a spring 310 that may carry current to a wire connector 420 that engages a wire to electrically connect to the module's electrical components from a shank 430 that contacts the conductive structures. A second contact 431 that is adjacent to the first contact 430 is configured to engage the second conductive structure, the first and second contacts configured to electrically connect to the panel assembly to deliver power from the power source to the first application module.

To hold and support the application module 200 at the panel assembly 110, and also to maintain the electrical connection of the contact studs with the conductive structures, the application module 200 may include an attachment feature, such as a fastener, magnet, clip, or the like, that is configured to engage an outer ceiling surface of the panel assembly 12 or one of the conductive structures. For example, as shown in FIGS. 4C and 5, the application module 200 may include one or more magnets 435 that are configured to physically bias the application module 200 against the ceiling surface of the panel assembly 110 or conducting structure 120 and firmly support it. The engagement of the magnets 435 may also cause the spring 410 to compress and bias the second contact 430 against the conductive structure. The magnets 28, for example, magnetically attach to the first conductive structure 120. As another example, an application module may have an attachment feature that includes a mechanical connection, such as a threaded engagement feature or a sliding latch, which engages a corresponding attachment feature at the panel assembly to mount the application module at the ceiling surface.

As shown in FIG. 5, the application module 200 is configured to attach to one of a plurality of locations 122 disposed over the outer panel 120 of the panel assembly 110. The inner conductive panel of the panel assembly may not have any holes or openings, at least at the central portion of the inner conductive panel that is aligned with the openings 122 disposed through the outer conductive panel 120. Instead, the inner conductive panel is a generally planar sheet of metal, which prevents rear access to the front or outer panel 120 and over insertion of the contact stud through the outer panel 120.

The outer conductive panel 120, as shown in FIG. 5, has openings 122 that allow a contact stud of the application module 200 to engage at a plurality of locations, both vertically and horizontally, over the panel assembly 110. The openings 122 disposed over the outer conductive panel 120 may define the plurality of locations 122 for engaging the application module 200. The openings 122 in the outer panel 120 may have a shape that corresponds with a contact stud, such as a circular hole. Alternatively, it is contemplated that holes with other conceivable shapes, such as orthogonal shapes or elongated slots, may be formed in addition to or in place of circular shaped holes at the outer panel. Further, it is understood that the holes may have various different sizing and spacing from each other from the illustrated example.

The outer and inner panels are substantially planar and oriented in planar parallel alignment with each other. It is also contemplated that other examples of the panels may be curved or have angular transition and may still be provided in spaced parallel alignment. Also, the panel assembly 110 may include an insulating spacer disposed between the panels maintain the spacing away from each other, such as with an electrically insulating stand-off piece, such as a plastic washer, or insulating substrate layer, such as a fiberglass sheet, disposed between the outer and inner conductive panels. Alternatively, the panels may be insulated from each other by an air gap, which may be maintained by the rigidity of the panels and any supportive structure of the frame 140 that support the panels.

The application module 200 may have a first contact that is configured to engage the outer panel 120 and a second contact that is configured to extend through the outer panel 120 and engage the inner panel. The second contact on the application module 200 is electrically insulated from the first contact and the outer panel 120 for the panel assembly 110 to deliver power to the engaged application module 200. The application module 200 may include a housing and a single stud that protrudes from a rear portion of the housing. The first contact of the application module 200 that engages the outer panel 120 may be disposed at a base portion of the contact stud. The second contact of the application module 200 is then disposed at a tip portion of the stud for extending through an opening 122 to engage the inner panel.

The singular contact stud of the application module 200 thus contains two independent contacts, insulated from one another, each of which make contact with a different panel (inner and outer). This allows electricity to conduct through the single stud, since it contains both isolated legs of the circuit.

Figure 7:
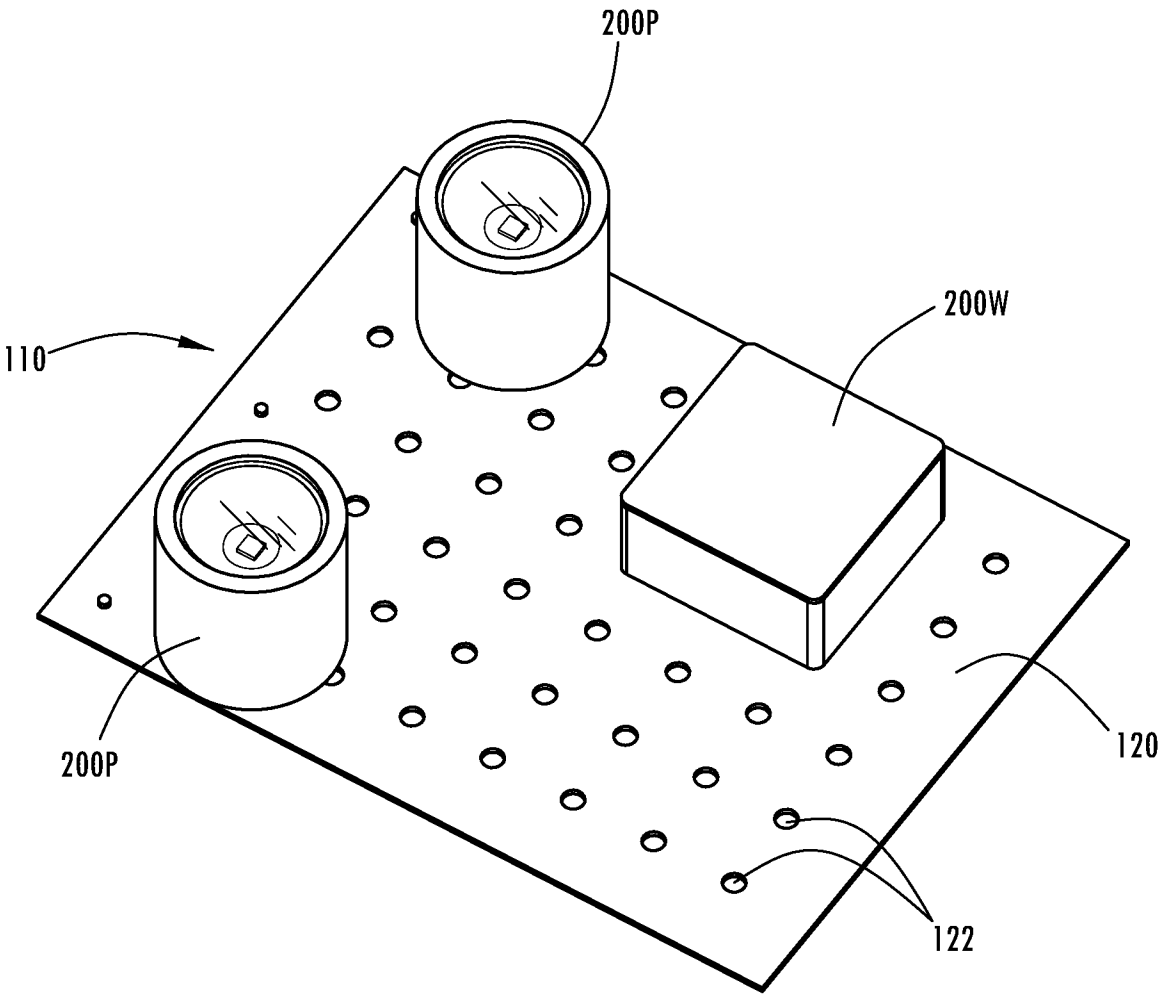
FIG. 7 is a perspective view of a panel assembly of the ceiling panel system, showing multiple application modules engaged to the panel assembly.
Figure 8:
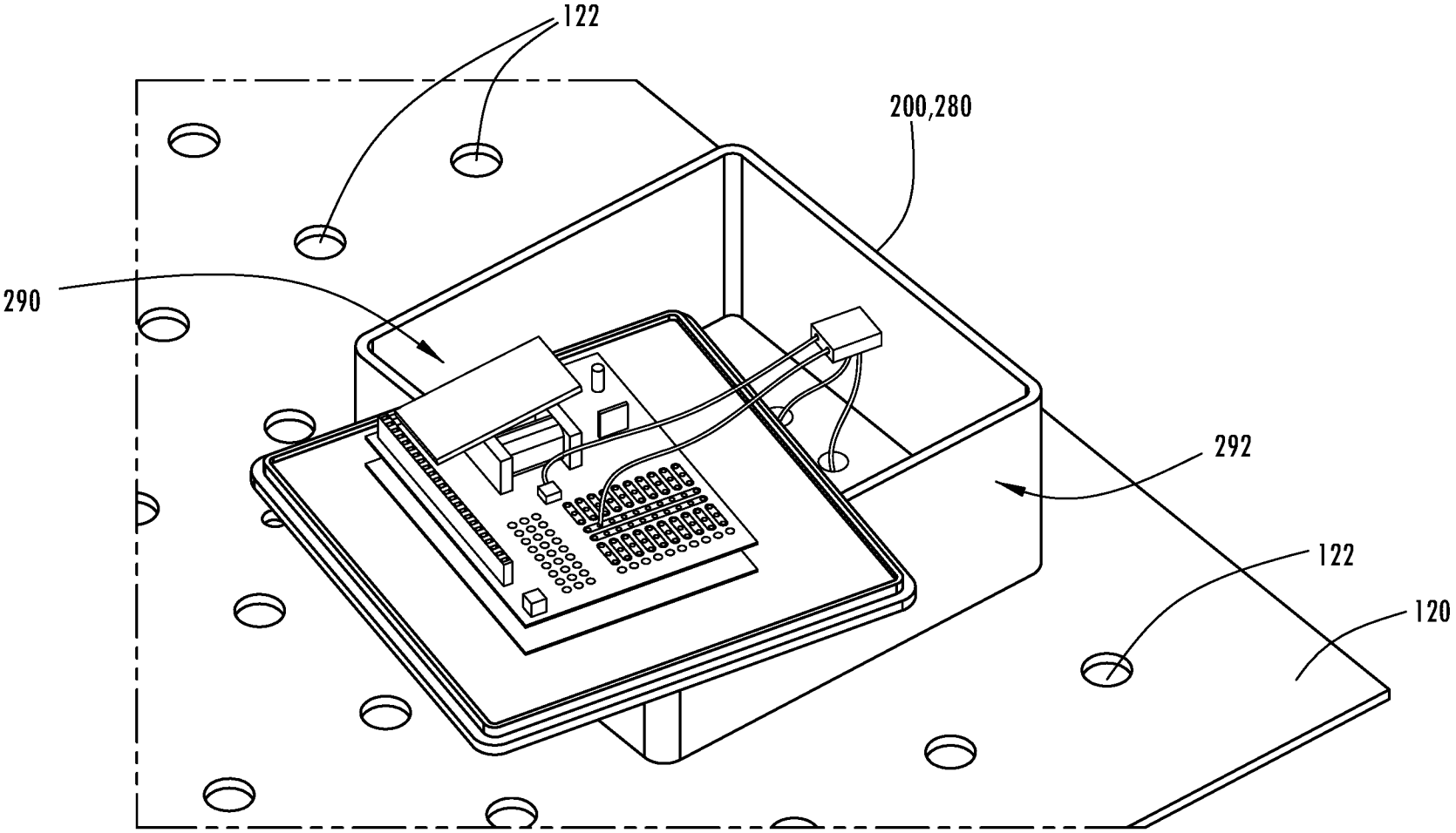
FIG. 8 is an enlarged perspective view of the ceiling panel system of FIG. 7, showing a cover of an application module remove to expose the interior of an application module.

Now referring to FIGS. 7 and 8, the application module 200 may include a housing 280 that has an outer portion that houses the internal component or components 290 of the module 200 and an inner portion that houses the stud assembly 292. The inner portion may include cavities that may receive magnets configured to bias the application module 200 against the outer panel 120 when the contacts are in engagement with the respective outer and inner panels. The internal component or components 290 electrically connect to the panel assembly via a connector that is configured to engage both conductive structures.

Thus, the application module may electrically connect with the engaged location of the panel assembly so as to power or supply electricity to the integrated component or components of the application module. The panel assembly may include an outer cover that conceals the electrical elements or members that are integrated into the panel assembly, such that the application module may pierce through the outer cover to engage the electrical elements or members and form an electrical connection therewith. The panel assembly may optionally include conductive plates that are spaced from each other, such that the application module may engage through at least one of the conductive plates to form an electrical connection with the panel assembly. In some examples, the ceiling panel system includes a plurality of independent or interconnected panel assemblies.

The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Also for purposes of this disclosure, the terms "upper," "lower," "right," "left," "rear," "front," "vertical," "horizontal," "inner," "outer," "downward-facing," "upward-facing," and derivatives thereof shall relate to the system as oriented relative to the building structure in FIG. 1. However, it is to be understood that it may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A ceiling panel system comprising:

a panel assembly having a ceiling surface and first and second conductive structures spaced from each other and spanning beneath the ceiling surface;

a first application module configured to engage one of a plurality of locations disposed over the ceiling surface of the panel assembly, wherein the first application module comprises:

a wireless receiver;

a first contact configured to engage the first conductive structure;

a second contact configured to engage the second conductive structure; and wherein the second contact is electrically insulated from the first contact and the first conductive structure for the panel assembly to deliver power to the first application module;

a second application module configured to engage a different one of the plurality of locations disposed over the ceiling surface of the panel assembly and receive power from the first conductive structure;

wherein the first application module is configured to receive wireless commands at the wireless receiver; and wherein, responsive to receiving wireless commands at the wireless receiver, the first application module transmits the received commands over the first conductive structure to the second application module.

2. The ceiling panel system of claim 1, wherein the first and second application modules each comprise an attachment feature that is configured to attach and support the respective application module at the ceiling surface of the panel assembly.

3. The ceiling panel system of claim 2, wherein the attachment feature comprises a magnet arranged to bias the respective application module against the ceiling surface of the panel assembly.

4. The ceiling panel system of claim 1, wherein the first conductive structure comprises a metal panel having a plurality of openings that define the plurality of locations for engaging an application module, and wherein the ceiling surface of the panel assembly is defined by the metal panel.

5. The ceiling panel system of claim 1, wherein the second conductive structure comprises a metal panel disposed in generally parallel planar alignment with the first conductive structure, and wherein the second contact is configured to extend through the first conductive structure to engage and form an electrical connection at the metal panel.

6. The ceiling panel system of claim 1, wherein the panel assembly includes an insulating spacer disposed between the first and second conductive structures to maintain spacing away from each other.

7. The ceiling panel system of claim 1, wherein the second application module comprises a light source.

8. The ceiling panel system of claim 1, further comprising a plurality of panel assemblies.

9. The ceiling panel system of claim 1, wherein the wireless receiver comprises one of a Wi-Fi receiver or a Bluetooth receiver.

10. The ceiling panel system of claim 1, further comprising a third application module configured to engage a different one of the plurality of locations disposed over the ceiling surface of the panel assembly than the first application module and the second application module, and responsive to receiving wireless commands at the wireless receiver, the first application module transmits the received commands over the first conductive structure to each other application module.

11. The ceiling panel system of claim 1, wherein the first conductive structure provides DC power to each application module.

12. The ceiling panel system of claim 1, wherein the received commands are transmitted over the first conductive structure using a serial protocol.

13. A ceiling panel system comprising:

a panel assembly having first and second conductive structures spaced from each other in planar parallel alignment and spanning horizontally to define a downward-facing ceiling surface, the panel assembly configured to electrically connect to a power source for delivering power from the power source;

a first application module configured to engage one of a plurality of locations disposed at the ceiling surface of the panel assembly and receive power from the power source, wherein the first application module comprises:

a wireless receiver configured to receive a wireless command;

a first contact configured to engage the first conductive structure; and a second contact configured to engage the second conductive structure, the first and second contacts configured to electrically connect to the panel assembly to deliver power from the power source to the first application module;

a second application module comprising an output device, the second application module configured to engage a different one of the plurality of locations and deliver power from the power source to the output device; and wherein, responsive to receiving a wireless command at the wireless receiver, the first application module transmits the received commands over the panel assembly to the second application module, and wherein the commands received from the first application module operate to control functionality of the output device.

14. The ceiling panel system of claim 13, wherein the first and second application modules each comprise an attachment feature that is configured to attach and support the respective application module at the ceiling surface of the panel assembly.

15. The ceiling panel system of claim 14, wherein the attachment feature comprises a magnet arranged to bias the respective application module against the ceiling surface of the panel assembly.

16. The ceiling panel system of claim 13, wherein the first conductive structure comprises a metal panel having a plurality of openings that define the plurality of locations for engaging an application module, and wherein the second contact is configured to extend through one of the plurality of openings to engage and form an electrical connection at the second conductive structure.

17. The ceiling panel system of claim 13, wherein the output device comprises a light source.

18. The ceiling panel system of claim 17, wherein the first application module comprises a lighting device, and wherein responsive to receiving the wireless command at the wireless receiver and transmitting the received commands, the first application module operates to control functionality of the lighting device in substantially same manner as the light source of the second application module.

19. A ceiling panel system comprising:

a panel assembly having first and second conductive structures spaced from each other in planar parallel alignment and spanning horizontally to define a ceiling surface, the panel assembly configured to electrically connect to a power source for delivering power from the power source;

a first application module configured to engage a first one of a plurality of locations disposed at the ceiling surface of the panel assembly and receive power from the power source, wherein the first application module comprises:

a wireless receiver configured to receive a wireless command;

a first contact configured to engage the first conductive structure; and a second contact configured to engage the second conductive structure, the first and second contacts configured to electrically connect to the panel assembly to deliver power from the power source to the first application module;

a second application module comprising an output device, the second application module configured to engage a second one of the plurality of locations and deliver power from the power source to the output device of the second application module;

a third application module comprising an output device, the third application module configured to engage a third one of the plurality of locations and deliver power from the power source to the output device of the third application module; and wherein, responsive to receiving a wireless command at the wireless receiver, the first application module transmits the received commands over the panel assembly to the second and third application modules, and wherein the commands received from the first application module operate to control functionality of the output devices of the second and third application modules.

20. The ceiling panel system of claim 19, wherein the first conductive structure provides DC power to each application module, and wherein the received commands are transmitted over the first conductive structure using a serial protocol.

* * * * *